US007121173B2

(12) United States Patent
Chen

(10) Patent No.: US 7,121,173 B2
(45) Date of Patent: Oct. 17, 2006

(54) TOOL HANDLE SELF-CONTAINED A SET OF HEAD TIPS

(75) Inventor: Chun Yong Chen, Taipei (TW)

(73) Assignee: Nieh Chuang Industrial Co., Ltd., Taipei (TW)

( * ) Notice: Subject to any disclaimer, the term of this patent is extended or adjusted under 35 U.S.C. 154(b) by 73 days.

(21) Appl. No.: 11/061,655

(22) Filed: Feb. 22, 2005

(65) Prior Publication Data

US 2005/0279194 A1 Dec. 22, 2005

Related U.S. Application Data

(63) Continuation of application No. 10/867,672, filed on Jun. 16, 2004.

(30) Foreign Application Priority Data

Sep. 3, 2004 (TW) ..... 93214109 U

(51) Int. Cl.
*B25B 23/16* (2006.01)
*B25G 1/08* (2006.01)

(52) U.S. Cl. ..... 81/177.4; 81/490; 81/439

(58) Field of Classification Search ..... 81/437–439, 81/490, 177.4

See application file for complete search history.

(56) References Cited

U.S. PATENT DOCUMENTS 5,566,596 A * 10/1996 Lin ..... 81/490
6,173,467 B1 * 1/2001 Chou ..... 7/165
6,196,093 B1 * 3/2001 Hu ..... 81/490
2002/0174749 A1 * 11/2002 Clemons ..... 81/490
2003/0024356 A1 * 2/2003 Kozak ..... 81/490

* cited by examiner

*Primary Examiner*—D. S. Meislin
(74) *Attorney, Agent, or Firm*—Troxell Law Office, PLLC

(57) ABSTRACT

A tool handle self-contained a set of head tips comprises a handle main body, a set of head tips, a fixing seat and a stop member. The handle main body has on its bottom a fixing hole, and has a receiving groove on a lateral side thereof. The head-tip set includes a base, a protruding column raised from the base and some holding areas on the base; the protruding column has on its upper end a stepped portion; the holding areas each holds and fixes a head tip; when the head-tip set assembled with the receiving groove, the bottom of the base is flush with a lateral side of the handle main body, and the top surface of the protruding column forms at a hole of the receiving groove a pressing area for pressing to push out the head-tip set. A head tip can be fixed on the bottom of handle main body for use as a screwdriver. The fixing seat is fixed in the engaging socket on the bottom of the handle main body; the stop member can be extended through the slot to make firm of the connecting of the fixing seat with the handle main body and a head tip with the fixing hole.

8 Claims, 6 Drawing Sheets

TOOL HANDLE SELF-CONTAINED A SET OF HEAD TIPS

The present application is a continuation in part patent application of Ser. No. 10/867,672 filed on Jun. 16, 2004.

BACKGROUND OF THE INVENTION

1. Field of the Invention

The present invention relates to a tool handle self-contained a set of head tips, and more particularly to a handle with a set of head tips self-contained inside, of which the appearance is continuous and smooth and the dropping of the set of head tips does not occur. By pressing the pressing area of the set of head tips, the set can be easily retracted from the handle main body, a head tip can be firmly fixed at the bottom of the handle to form a screwdriver. The present invention is applicable to use as a handle of any of various hand tools.

2. Description of the Prior Art

There are many chances to use handles of various hand tools, such as iron hammers, screwdrivers etc. for repairing failed articles, particularly a user can enjoy the fun of DIY in using a hand tool, and further can save fees for repairing.

Kinds of handles of hand tools are numerous, what people use most often are screwdrivers, they can be used to screw on or off screws; things as small as a watch or a cell phone and as large as a building of steel may use screwdrivers to screw on or off screws, different screwdrivers are required for different head tips; for instance, common Phillips screws are screwed off with Phillips head tips, screw heads with hexagonal recesses are screwed off with hexagonal head tips etc., particularly when depths of the recesses on different screw heads are not same, a good work needs a good instrument, a suitable head tip can make propitious of using a screwdriver; thereby, there have been various screwdrivers in the industry for choice of users.

By the fact that screwdrivers are widely used, nearly all kinds of engineering need them, hence in the conventional techniques, screwdrivers are designed to connect the head tips directly on the bottom of handles of hand tools; such structures can have an added value of having two functions, but are respectively of a single specification, the scope of utility of them is limited.

In view of this, the inventor provides a handle of a hand tool capable of using as a screwdriver that can self-contain various head tips well, and the abovementioned problem can thus be solved.

SUMMARY OF THE INVENTION

The main objective of the present invention is to provide a handle of a hand tool capable of self-containing therein a set of head tips; by pressing a pressing area, the set of head tips can be easily retracted, the contour of the handle is tidy and smooth and has a good appearance.

Another objective of the present invention is to provide a handle of a hand tool capable of firmly fixing a head tip on the bottom of main body of the handle.

In order to achieve the above objectives, the abovementioned handle of a hand tool of the present invention comprises a handle main body, a set of head tips, a fixing seat and a stop member.

The handle main body has a receiving groove on a lateral side thereof, the receiving groove has on one side thereof a hole and has on the other side thereof an opening; the handle main body has an engaging socket on its bottom. The head-tip set includes a base, a protruding column raised from the base and a plurality of holding areas on the base; wherein the holding areas each holds and fixes a head tip, the bottom of each head tip can be matched with a fixing hole on the bottom of the fixing seat on the main body of the handle; when the head-tip set is engaged for assembling with the receiving groove, the top surface of the protruding column forms at the hole of the receiving groove a pressing area for pushing out the head-tip set, and the bottom of the base is made flush with the surface of a lateral side of handle main body. The fixing seat can be engaged and fixed in the engaging socket on the bottom of main body of the handle; the fixing seat is provided on its bottom with the fixing hole extending downwards, an inner wall of the fixing hole has a cut, the fixing hole is provided at its lower end with a slot below the cut. The stop member can be extended through the slot, and has a first stop portion and a second stop portion; so that when the fixing seat is fixedly engaged in the bottom of main body of the handle, the first stop portion can firmly fix the fixing seat on main body of the handle, while the second stop portion can be extended into the abovementioned cut to make firm of the connecting of a head tip with the fixing hole.

The present invention will be apparent after reading the detailed description of the preferred embodiment thereof in reference to the accompanying drawings.

DETAILED DESCRIPTION OF THE PREFERRED EMBODIMENT

Figure 1:
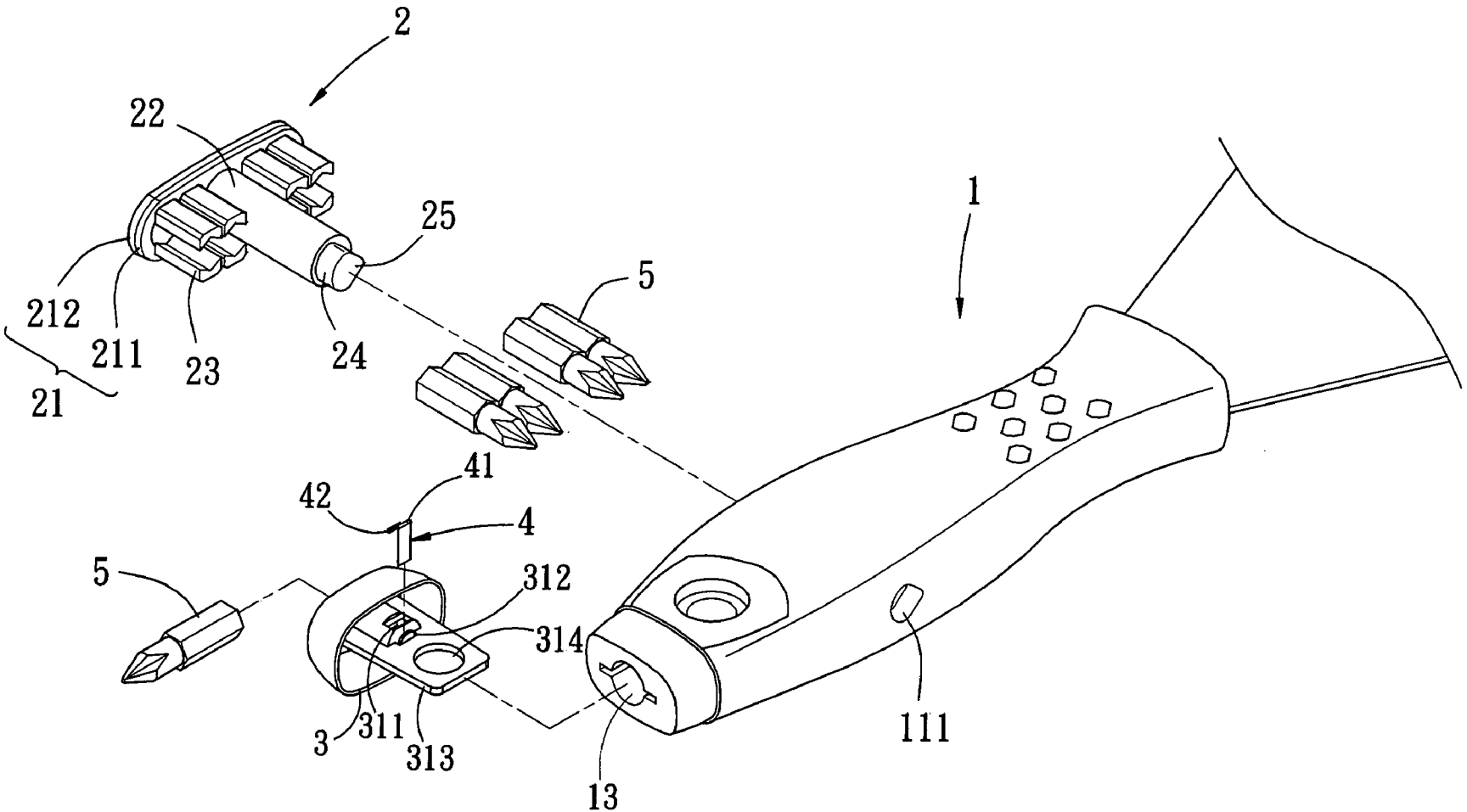
FIG. 1 is an analytic perspective view of an embodiment of the present invention.
Figure 2:
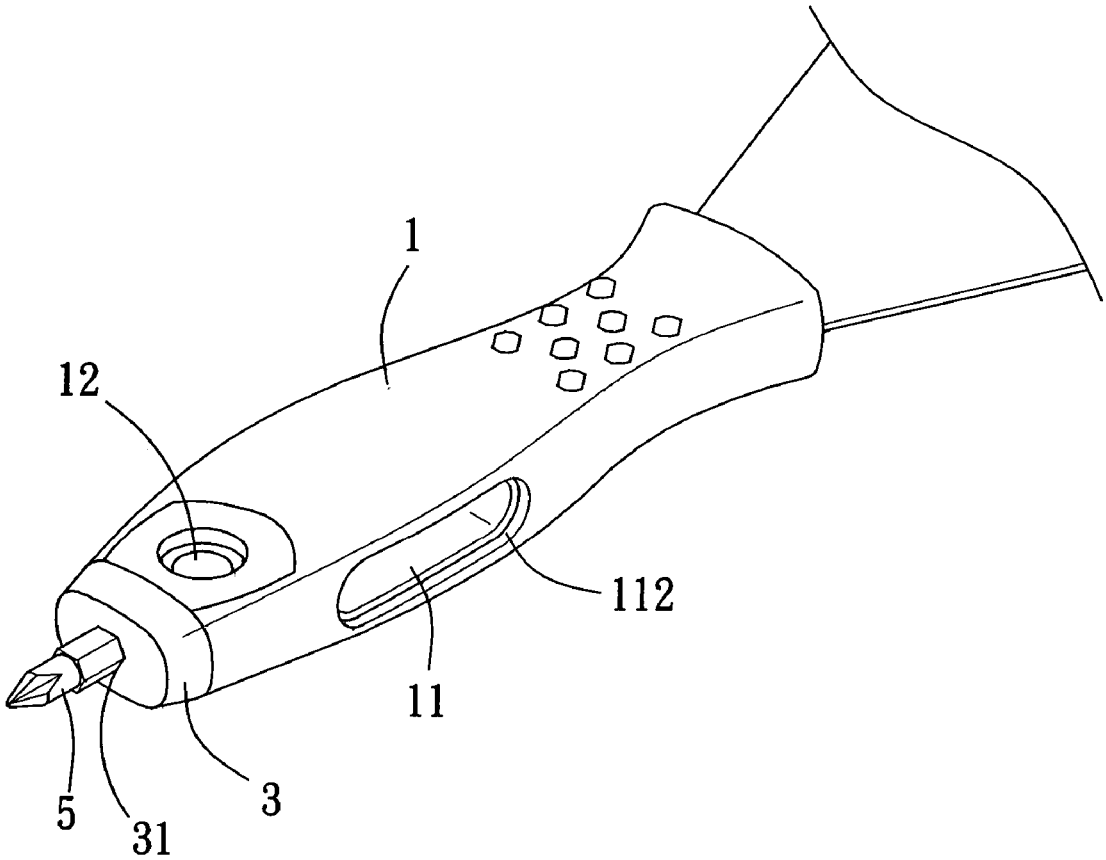
FIG. 2 is a perspective view of the embodiment of the present invention viewing from a side with an opening of the handle of the hand tool.
Figure 3:
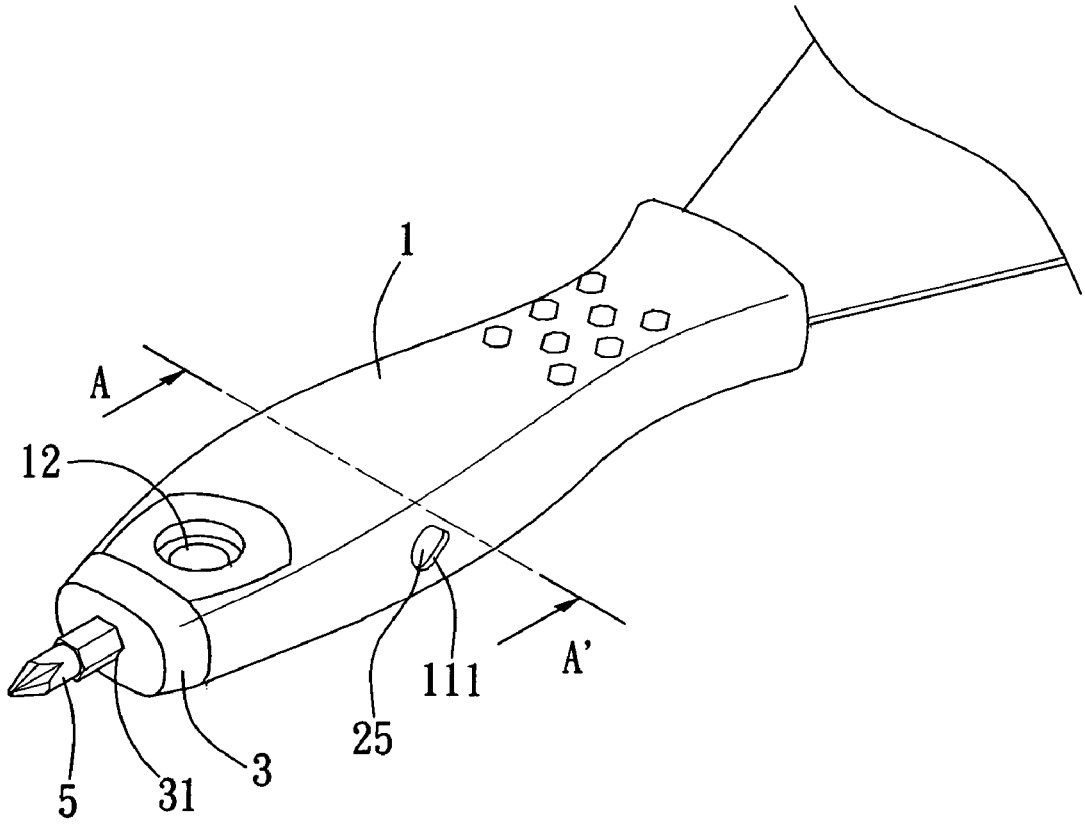
FIG. 3 is a perspective view after assembling of the handle of the hand tool of the embodiment of the present invention stored therein with a set of head tips.
Figure 4:
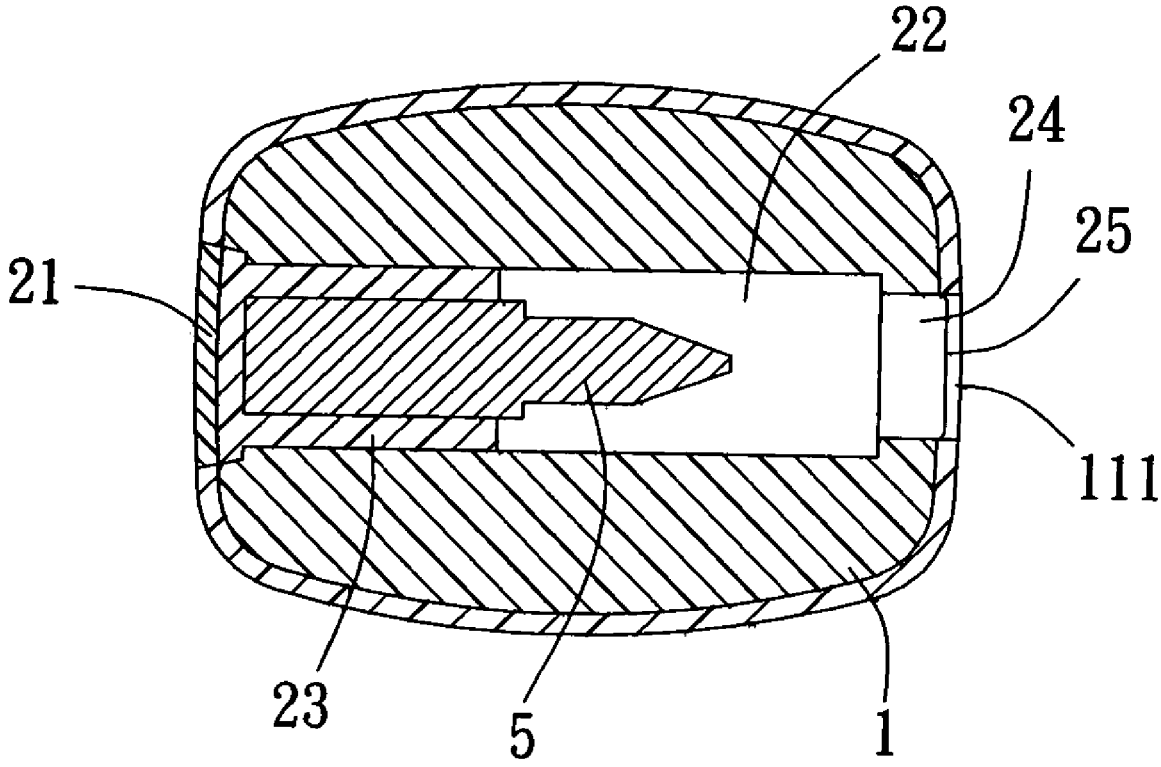
FIG. 4 is a sectional view taken from a section line A–A' of FIG. 3.

Referring to FIGS. 1–4 showing an embodiment of a handle of a hand tool of the present invention, the handle is comprised of: a handle main body 1, a set of head tips 2, a fixing seat 3 and a stop member 4.

The handle main body 1 is made of hard plastic covered with an elastic plastic skin; thereby it is good for holding and is not subjected to slipping off. The handle main body 1 has a receiving groove 11 on a lateral side thereof, the receiving groove 11 has on one side thereof a hole 111 and has on the other side thereof an opening 112; the opening 112 is larger than the hole 111, so that the head-tip set 2 can get into the opening 112 and can be partially revealed out of the hole 111. The handle main body 1 is provided near its bottom with a round hole 12; and has an engaging socket 13 on the bottom.

The head-tip set 2 includes a base 21, a protruding column 22 raised from the base 21 and a plurality of holding areas 23 on the base 21; wherein the base 21 of the head-tip set 2 includes an upper layer 211 and a lower layer 212; the upper layer 211 is made of hard plastic, the lower layer 212 is an elastic plastic skin same as that of the surface of the handle main body 1. In this embodiment, the holding areas 23 of the base 21 each includes a pair of detent sheets with their inner sides bending inwardly for holding the bottom of a head tip 5; each head tip 5 is fixed in a holding area 23. The embodiment of the present invention has four holding areas 23, plus that the fixing seat 3 can always receive a head tip 5, it can have at least five head tips 5 of different sizes and types such as the Phillips Type, slotted type and hexagon type etc. However, one skill in this art can design the amount and types of the head tips 5 according to the size of the interior space of handle main body 1, or design to get other kinds of tools rendering suitable for fixing on the holding areas 23; the scope of the present invention is not limited to these.

The fixing seat 3 can be engaged and fixed in the engaging socket 13 on the bottom of handle main body 1; the fixing seat 3 is provided on its bottom with a fixing hole 31 extending downwards; the fixing hole 31 and the bottom of a head tip 5 mutually correspond by shape (such as Phillips Type, slotted type and hexagon type). An inner wall of the fixing hole 31 has a cut 311; the fixing hole 31 is provided at its lower end with a slot 312 below the cut 311, an elongate sheet 313 extends down from the two lateral sides of the fixing hole 31, a hole 314 is provided on the elongate sheet 313 for aligning with the abovementioned round hole 12.

Figure 5:
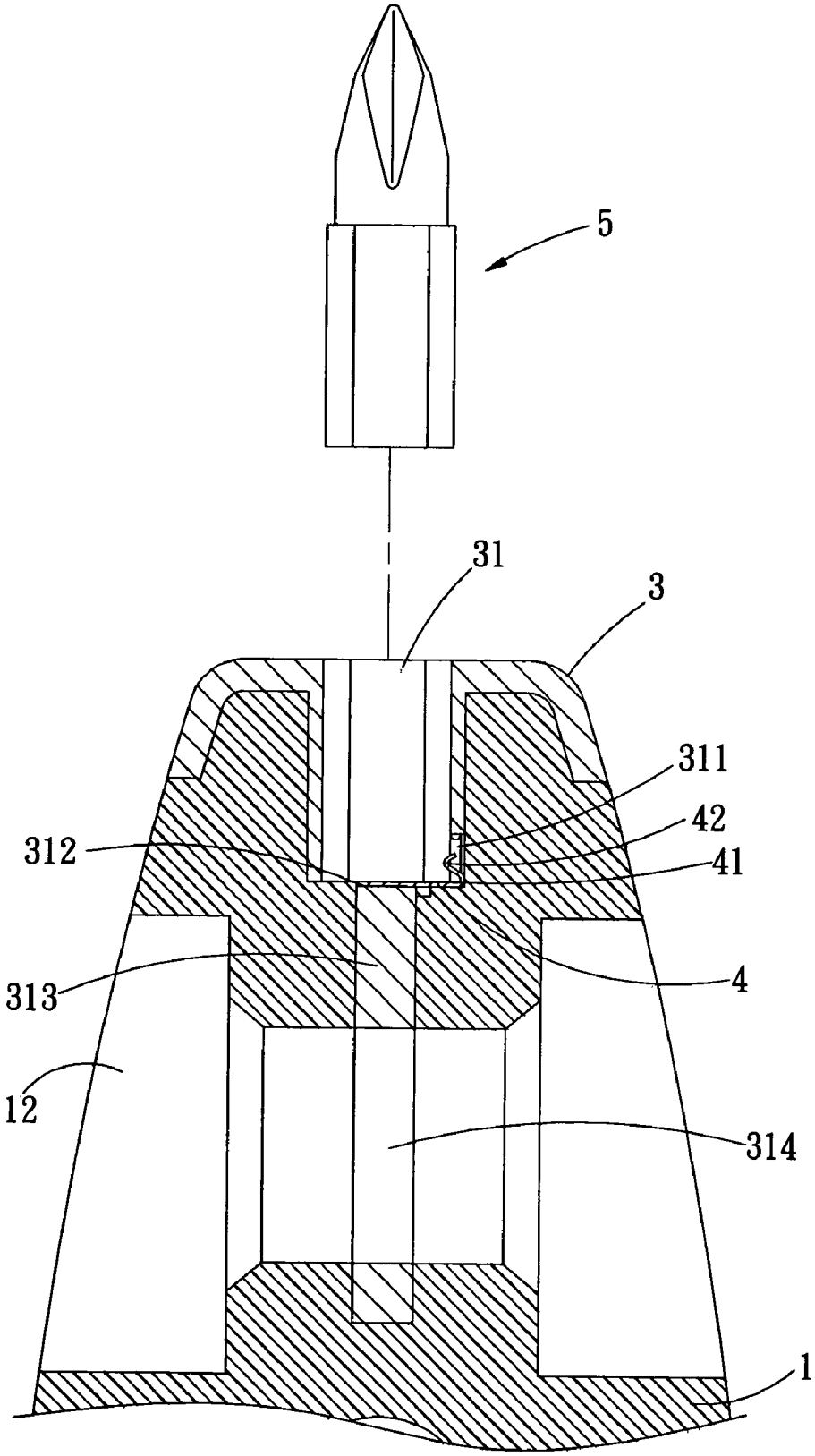
FIG. 5 is a sectional view of the embodiment of the present invention showing connecting of a head tip with a fixing seat.
Figure 6:
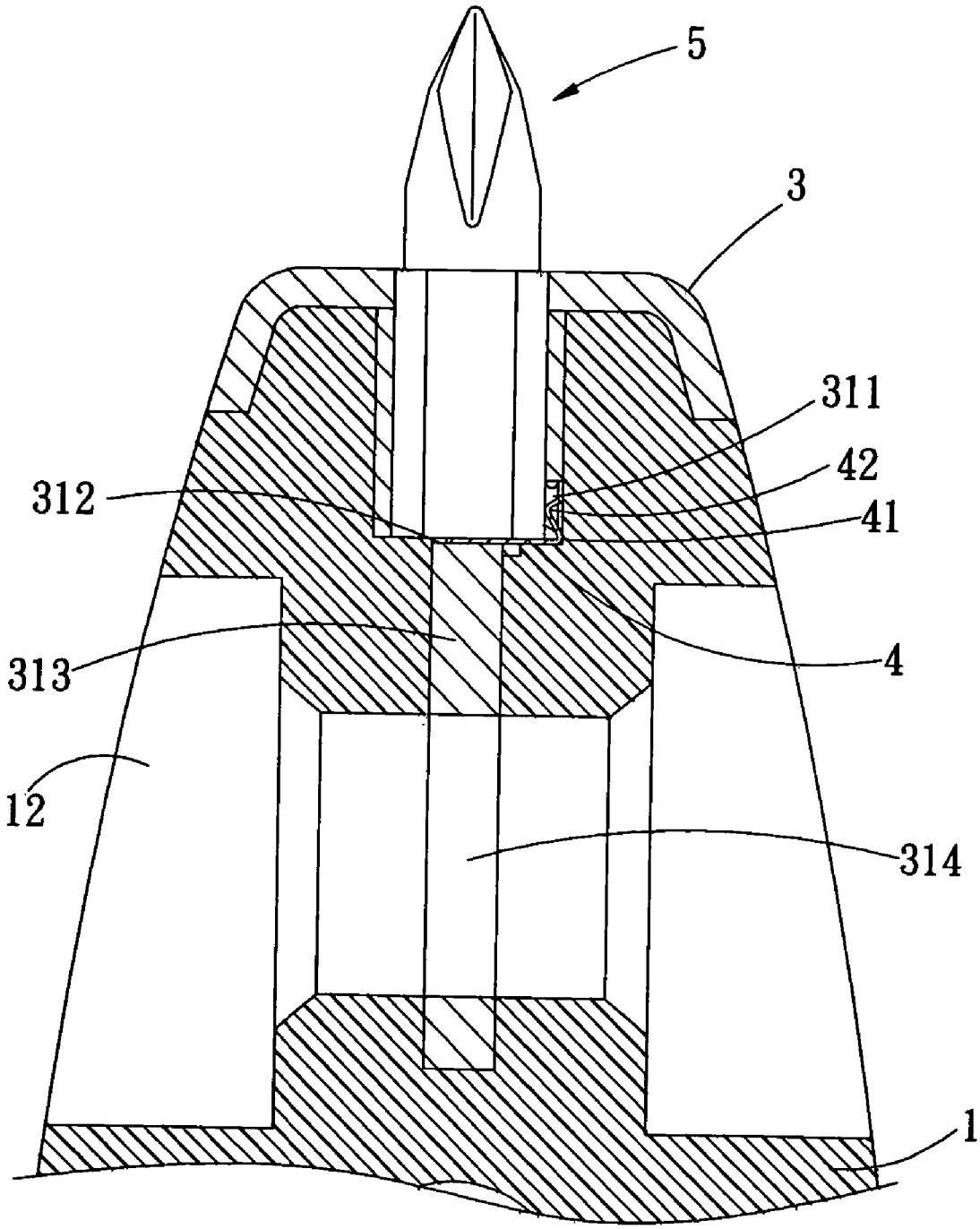
FIG. 6 is a sectional view of the embodiment of the present invention after connecting of the head tip with the fixing seat.

The stop member 4 is in a shape of "L", it can be extended through the slot 312, and has a first stop portion 41 and a second stop portion 42; so that when the fixing seat 3 is fixedly engaged in the bottom of the handle main body 1, the first stop portion 41 can firmly fix the fixing seat 3 on the handle main body 1, while the second stop portion 42 can be extended into the abovementioned cut 311 to make firm of the connecting of a head tip 5 with the fixing hole 31 (as shown in FIGS. 5 and 6).

And as shown in FIG. 1, the protruding column 22 raised from the base 21 of the head-tip set 2 is provided on its upper end with a stepped portion 24, a top surface 25 of the protruding column 22 is in the shape of an oval in order that the stepped portion 24 of the protruding column 22 can be aligned and engaged with the inner wall of the hole 111 of the receiving groove 11 in favor of alignment and self-containing, in case of wrong direction, the top surface 25 of the protruding column 22 is unable to be inserted into the hole 111 of the receiving groove 11.

In application, referring again to FIGS. 1–6, when the fixing seat 3 is fixedly engaged in the bottom of the handle main body 1, the first stop portion 41 of the stop member 4 can firmly fix the fixing seat 3 on the handle main body 1, while the second stop portion 42 can be extended into the abovementioned cut 311; thereby when a head tip 5 is removed from a holding area 23, and when the bottom of the head tip 5 is engaged with the fixing hole 31 of the fixing seat 3 on the bottom of the handle main body 1, the bottom of the head tip 5 exactly abuts against the second stop portion 42 of the stop member 4 to make firm of the connection of the head tip 5 with the fixing hole 31, the head tip 5 will not drop even when the handle main body 1 is held to face down. Thereby the handle main body 1 can be used for fixing and screwing off various screws in a practical and convenient way by exerting force by rotating itself.

When the head-tip set 2 is assembled in the receiving groove 11, the bottom of the base 21 will be flush with the surface of a lateral side of the handle main body 1; that is, the bottom of the base 21 exactly fills up the opening 112 of the receiving groove 11. When viewing from the side with the opening 112 of the receiving groove 11, the head-tip set 2 is engaged and self-contained in the handle main body 1 and is not subjected to dropping even when in shaking or collision; when viewing from the side with the hole 111 of the receiving groove 11, the top surface 25 of the protruding column 22 forms a pressing area at the hole 111 of the receiving groove 11 for pushing the head-tip set 2 out of the receiving groove 11 by pressing the pressing area, and the head tips 5 are not subjected to losing, the modeling of the handle main body 1 can be gorgeous after assembling.

The present invention has been disclosed as above, it is only for illustrating a preferred embodiment of the present invention, and not for giving any limitation to the scope of the present invention. It will be apparent to those skilled in this art that various equivalent modifications or changes made without departing from the spirit of this invention shall fall within the scope of the appended claims to be protected.

The present invention has the following advantages:

1. The handle self-contained therein with head-tip set has a contour of good appearance, and the head tips are not subjected to dropping; by pressing a pressing area of the head-tip set revealed on one side of the handle main body, the set of head tips can be easily retracted from the handle main body, such operation is convenient.
2. The amount, sizes and kinds of the head tips of the head-tip set can be designed or changed according to requirements; this is convenient for a user to make change with flexibility.
3. With the design of the stop member, connecting of the fixing seat with the handle main body and connecting of a head tip with the fixing hole can be firm.

The handle of the hand tool self-contained therein with the head-tip set is applicable to use as a handle of any of various hand tools; thereby functions of the handle of the hand tool is not limited to one kind, the added-on value of the handle of the hand tool can thus be increased, it is thereby extremely industrially valuable.

In conclusion, the present invention surely can get the expected objects of it to provide a handle of a hand tool that can be self-contained therein with changeable head tips; the head-tip set is convenient for fixing and retracting from the handle of the hand tool, and the present invention is suitable for use as a handle of any of various hand tools.

The invention claimed is:

1. A tool handle self-contained a set of head tips comprising:

a handle main body having a receiving groove on a lateral side thereof, said receiving groove has on one side thereof a hole and has on the other side thereof an opening, said handle main body has an engaging socket on a bottom thereof;

a head-tip set including a base, a protruding column raised from said base and a plurality of holding areas on said base, wherein said holding areas each is provided for holding and fixing a bottom of a head tip; when said head-tip set is assembled in said receiving groove, a top surface of said protruding column forms a pressing area at said hole of said receiving groove for pushing said head-tip set out of said receiving groove, a bottom of said base is flush with a surface of a lateral side of said handle main body;

a fixing seat engaged and fixed in said engaging socket on said bottom of said handle main body, said fixing seat is provided on a bottom thereof with a fixing hole extending downwards, an inner wall of said fixing hole has a cut, said fixing hole is provided at a lower end thereof with a slot below said cut; and a stop member extended through said slot, and having a first stop portion and a second stop portion, so that when said fixing seat is fixedly engaged in said bottom of said handle main body, said first stop portion firmly fixes said fixing seat on said handle main body while said second stop portion is adapted to extending into said cut to make firm of connecting of said head tip with said fixing hole.

2. The handle of a hand tool as claimed in claim 1, wherein said handle main body is made of hard plastic covered with an elastic plastic skin.

3. The handle of a hand tool as claimed in claim 1, wherein said base of said head-tip set includes two layers of which an upper layer is made of hard plastic and a lower layer is an elastic plastic skin.

4. The handle of a hand tool as claimed in claim 1, wherein said protruding column is provided on its upper end with a stepped portion, a top surface of said protruding column is in the shape of an oval in order that said stepped portion of said protruding column is aligned and engaged with an inner wall of said hole of said receiving groove.

5. The handle of a hand tool as claimed in claim 1, wherein said holding areas each includes a pair of detent sheets with inner sides bending inwardly.

6. The handle of a hand tool as claimed in claim 1, wherein said handle main body is provided near said bottom thereof with a round hole, an elongate sheet extends down from two lateral sides of said fixing hole, a hole is provided on said elongate sheet for aligning with said round hole.

7. The handle of a hand tool as claimed in claim 1, wherein said stop member is in a shape of "L".

8. The handle of a hand tool as claimed in claim 1, wherein said fixing hole and said bottom of said head tip mutually correspond by both having hexagon shapes.

* * * * *